US011737567B2

(12) United States Patent
Luo et al.

(10) Patent No.: US 11,737,567 B2
(45) Date of Patent: Aug. 29, 2023

(54) MULTI-GEAR SUPPORTING AND ADJUSTMENT MECHANISM, AND ADJUSTABLE SEAT

(71) Applicant: EAVY MEDICAL INSTRUMENTS (SHANGHAI) CO. LTD., Shanghai (CN)

(72) Inventors: Yun Luo, Shanghai (CN); Yun Gan, Shanghai (CN)

(73) Assignee: EAVY MEDICAL INSTRUMENTS (SHANGHAI) CO. LTD., Shanghai (CN)

( * ) Notice: Subject to any disclaimer, the term of this patent is extended or adjusted under 35 U.S.C. 154(b) by 35 days.

(21) Appl. No.: 17/611,792

(22) PCT Filed: May 11, 2020

(86) PCT No.: PCT/CN2020/089596
§ 371 (c)(1),
(2) Date: Nov. 16, 2021

(87) PCT Pub. No.: WO2020/233434
PCT Pub. Date: Nov. 26, 2020

(65) Prior Publication Data

US 2022/0232981 A1 Jul. 28, 2022

(30) Foreign Application Priority Data

May 23, 2019 (CN) ..... 201910435788.1

(51) Int. Cl.
*A47C 7/44* (2006.01)
*A47C 7/46* (2006.01)
*A47C 7/14* (2006.01)

(52) U.S. Cl.
CPC ..... *A47C 7/462* (2013.01); *A47C 7/14* (2013.01); *A47C 7/44* (2013.01); *A47C 7/445* (2013.01)

(58) Field of Classification Search
CPC .. A47C 1/024; A47C 7/44; A47C 7/14; A47C 7/445; A47C 7/462
(Continued)

(56) References Cited

U.S. PATENT DOCUMENTS 241,748 A * 5/1881 Strauss ..... A47C 1/14 297/354.12 X
319,537 A * 6/1885 Winter ..... A47C 20/027 5/643
(Continued)

FOREIGN PATENT DOCUMENTS

CN 106859094 A * 6/2017 ..... A47C 1/024
CN 109106121 A 1/2019
(Continued)

*Primary Examiner* — Rodney B White
(74) *Attorney, Agent, or Firm* — H&I Partners; C. Andrew Im; Jean-Christophe Hamann

(57) ABSTRACT

A multi-gear adjustable support mechanism includes a base plate, a support plate, a support element, a gear forming element having gear grooves and a limiting part and a gear controller having an abutting part and a platform. The support element includes a support crossbar for supporting the support plate at a different angle from the base plate. A moving surface of the gear forming element bears and supports the movement of the support crossbar. The platform is aligned with the moving surface at the position of the gear groove closest to the limiting part when the support crossbar moves and reaches the limiting part. The support crossbar moves on the surface of the platform part and passes the gear groove when the support crossbar returns from the limiting
(Continued)

part. An adjustable seat is provided including the multi-gear adjustable support mechanism.

18 Claims, 8 Drawing Sheets

(58) Field of Classification Search
USPC ..... 297/291, 354.12, 357
See application file for complete search history.

(56) References Cited

U.S. PATENT DOCUMENTS 1,103,730 A * 7/1914 Anderson ..... A47C 20/027 5/634
2,250,026 A * 7/1941 Laukhuff ..... A47C 20/027 5/634
2,663,029 A * 12/1953 Whitley ..... A47C 20/043 5/640
2,666,216 A * 1/1954 Schnaitter ..... A47C 20/043 5/660
3,206,247 A * 9/1965 Johnson ..... A47D 1/002 297/DIG. 2
3,276,817 A * 10/1966 Marple ..... A47C 1/146 297/283.1
3,370,885 A * 2/1968 Gale ..... A47C 1/026 297/328
3,800,338 A * 4/1974 Smith ..... A61G 7/015 5/617
3,856,350 A * 12/1974 Duke ..... A47C 5/12 297/354.12
6,029,669 A * 2/2000 Hammock ..... A61G 7/065 5/736
7,234,775 B2 * 6/2007 Serber ..... A47C 1/022 297/301.1
7,275,273 B2 * 10/2007 Lary ..... A47C 20/021 5/648
7,347,495 B2 * 3/2008 Beyer ..... A47C 7/445 297/284.3
7,484,802 B2 * 2/2009 Beyer ..... A47C 7/46 297/284.3
7,967,388 B2 * 6/2011 Kobayashi ..... B60N 2/22 297/357 X
8,272,691 B2 * 9/2012 Hsuan-Chin ..... A47C 7/402 297/285
8,313,143 B2 * 11/2012 Beyer ..... A47C 7/462 297/284.3
8,651,569 B2 * 2/2014 Andoloro ..... A47C 1/0303 297/354.13 X
8,764,110 B2 * 7/2014 Hsuan-Chin ..... A47C 7/44 297/291 X
8,845,024 B2 * 9/2014 Beyer ..... A47C 7/44 297/284.3
9,192,234 B2 * 11/2015 Grove ..... A47C 1/033
9,375,088 B2 * 6/2016 Andoloro ..... A47C 1/026
9,538,849 B2 * 1/2017 Beyer ..... A47C 7/46
9,687,079 B1 * 6/2017 Grove ..... A47C 7/445
9,700,138 B2 * 7/2017 Rechtien ..... A47C 1/032
10,264,885 B2 * 4/2019 Andoloro ..... A47C 1/0303
10,383,445 B2 * 8/2019 Serber ..... A47C 9/002
10,638,843 B2 * 5/2020 Andoloro ..... A47C 31/008
10,799,028 B2 * 10/2020 Deisig ..... A47C 7/443
11,246,418 B2 * 2/2022 Andoloro ..... A47C 7/503
11,337,525 B1 * 5/2022 Wu ..... A47C 7/448
2002/0108178 A1 * 8/2002 Francois ..... A45D 29/00 5/648
2009/0256407 A1 * 10/2009 Beyer ..... A47C 7/445 297/284.3
2015/0208809 A1 7/2015 Grove
2018/0161232 A1 * 6/2018 Grove ..... A47C 7/467
2022/0095797 A1 * 3/2022 Djankovich ..... A63B 21/02

FOREIGN PATENT DOCUMENTS

CN 110150890 A 8/2019
CN 209252132 U 8/2019
CN 210471575 U 5/2020
DE 202006016045 U1 * 6/2008 ..... A47C 7/405
DE 202008006179 U1 * 8/2008 ..... A47C 7/402
DE 202008006677 U1 * 10/2008 ..... A47C 7/445
DE 202016107139 U1 * 6/2017 ..... A47C 1/024
KR 100960608 B1 * 6/2010 ..... A47C 1/024

* cited by examiner

MULTI-GEAR SUPPORTING AND ADJUSTMENT MECHANISM, AND ADJUSTABLE SEAT

RELATED APPLICATIONS

This application is a § 371 application of PCT/CN2020/089596 filed May 11, 2020, which claims priority from Chinese Patent Application No. 201910435788.1 filed May 23, 2019, each of which is incorporated herein by reference in its entirety.

FIELD OF THE INVENTION

The present invention pertains to the field of daily necessities and relates to a multi-gear adjustable support mechanism and an adjustable seat comprising the multi-gear adjustable support mechanism.

BACKGROUND OF THE INVENTION

Some daily appliances have support components. For example, seats such as chairs have backrests, which can support the waist and back of the user in a sitting state, and make the user feel comfortable. When users use these daily appliances, they usually adopt a posture that they feel comfortable. Accordingly, the support angles required by the users are different.

In order to generate a sufficient supporting force for different angles, the prior art discloses support mechanisms for adjusting angles, and these support mechanisms are suitable for these daily appliances. For example, an angle adjustment mechanism is provided between the cushion and the backrest of a car seat. And the user can manually or electrically adjust the angle of the backrest. This kind of support and adjustment mechanisms is relatively free in angle adjustment, but usually with complicated structure, large volume and high cost. Therefore, this kind of support and adjustment mechanisms is usually used in vehicles, train seats and other transportation, and it is difficult to be used in daily life. In contrast, there are also some relatively simple support mechanisms for angle adjustment in the prior art. For example, the sit board and the back plate of the seat are connected by a rotating shaft, and then a strut and a multi-gear member that cooperates with the strut (for example, a gear element with a plurality of grooves corresponding to different angle gears, etc.) is used to achieve angle adjustment. This type of support mechanism and the seat containing the support mechanism have the advantages of simple structure and low cost, but the seat is relatively inconvenient to use. And the user needs to operate with both hands after leaving the seat to adjust the angle.

SUMMARY OF THE INVENTION

The objective of the present invention is to provide a multi-gear adjustable support mechanism and an adjustable seat that are simple in structure and easy to use. The present invention adopts the following technical solutions.

The present invention provides a multi-gear adjustable support mechanism, characterized by comprising:

a base plate;

a support plate, which is rotatably installed on the base plate;

a support element, which is rotatably installed on the plate, and has a support crossbar part for supporting the support plate so as to support the support plate at a different angle from the base plate; a gear forming element, fixed on the support plate, on which a plurality of support gears arranged in a predetermined direction and corresponding to the different angles between the base plate and the support plate are formed; and a gear control element, which controls the movement of the support crossbar part on the gear forming element so that the support element supports the support plate in different the support gears, wherein the gear forming element has a moving surface which carries the movement of the support crossbar part, a plurality of gear grooves respectively corresponding to the support gears and capable of accommodating the support crossbar part are formed on the moving surface, and a limiting part corresponding to an unlock gear for unlocking is formed on the moving surface, the gear control element is movably arranged on the gear forming element in the predetermined direction, and the gear control element has a first abutting part which can abut against the support crossbar part and is positioned at an end of the gear control element close to the limiting part, and the gear control element has a platform part which is far from the limiting part and corresponding to the gear grooves, the support crossbar part abuts against the first abutting part and drives the gear control element to move when moving towards the limiting part in the predetermined direction, so as to make the platform part at least aligned with the moving surface which is positioned at the gear groove closest to the limiting part when the support crossbar part reaches the limiting part, thereby allowing the support crossbar part to move on the surface of the platform part and crosses the gear grooves when the support cross bar part returns from the limiting part.

Further, the end of the gear control element away from the limiting part has a second abutting part capable of abutting against the support crossbar part, and the support crossbar part abuts against the second abutting part and drives the gear control element to move when the support crossbar part moves in a direction away from the limiting part.

Further, the gear control element also has a recess positioned between the first abutting part and the platform part, the shape of the recess matches the shape of the gear groove, when the support gear crossbar part moves along the predetermined direction and drives the gear control element to move by abutting against the first abutting part, the recess is sequentially aligned with each of the gear grooves along with the movement of the gear control element, so that once the support crossbar part stops moving, the support crossbar part can enter the gear groove along the surface of the first abutting part and the recess, thereby entering corresponding the support gear.

Further, the number of the recesses is multiple and not greater than the number of the gear grooves, and the distance between adjacent the recesses is the same as the distance between adjacent the gear grooves.

Further, the multi-gear adjustable support mechanism further comprises a crossbar guiding element, which is used to provide the support crossbar part a tendency force that makes the support crossbar part to move into the gear groove, so that when the recess is aligned with the gear groove and the support crossbar part reaches the gear groove, the support crossbar part automatically enters the gear groove under the action of the tendency force.

Further, the crossbar guiding element is a hook-shaped element fixed on the support crossbar part, a first magnet element extending along the predetermined direction and distributed at least at each of the gear grooves is provided at the gear forming element, and a second magnet element is fixed on the hook-shaped element, the first magnet element and the second magnet element are attracted to each other by magnetic force, thereby generating the tendency force.

Further, a second magnet element is fixedly arranged on the gear control element, and the second magnet element and the first magnet element are attracted to each other by magnetic force, so that the gear control element is attracted to the gear forming element and can move relative to the gear forming element.

Further, the first magnet element is a magnetic metal sheet, and the second magnet element is a permanent magnet.

Further, the support control component further comprises a cover element covering the gear forming element.

Further, the crossbar guiding element is a sheet-shaped element that is fixed on the cover element by a plurality of springs and is in contact with the support crossbar part, the springs are all compression springs, and apply a force toward the second element on the crossbar guiding element, so that the crossbar guiding element applies the tendency force on the support crossbar part.

Further, the gear forming element is provided with a groove part extending along the predetermined direction, and the groove part is provided with a guiding groove extending along the predetermined direction, and the gear control element is movably arranged on the gear forming element through the guiding groove.

Further, the gear control element is provided with a fixture block embedded in the guiding groove, so that the gear control element can be movably arranged on the gear forming element in an up-and-down direction.

Further, the inner side of the guiding groove is further provided with an inner groove part corresponding to the gear groove, and the depth of the part of the inner groove corresponding to the gear groove is lower than the depth of the gear groove, both sides of the platform part are provided with third extension parts that are overlaid on the guiding groove, and the distance between the ends of two the third extension parts is greater than the width of the groove part, so that the gear control element can slide on the guiding groove by two the third extension parts.

Further, the widths of the platform part and the first abutting part are both smaller than the distance between the guiding grooves and at the same time greater than the distance between the inner groove parts, so that the support crossbar part drives the first abutting part to move, and the gear control element rotates through the shaft formed by two the extension parts when the first abutting part reaches the gear groove, so that the platform part and the first abutting part enter the gear groove, thereby guiding the support crossbar part to enter the gear groove.

Further, the length of the platform is greater than the distance between the ends of the gear grooves on both sides of the predetermined direction, so that the platform part is aligned with the moving surface positioned at the gear groove when the support crossbar part reaches the limiting part, thereby allowing the support crossbar part to cross all the gear grooves by the platform part.

Further, the multi-gear adjustable support mechanism further comprises a cover element, covering the gear forming element, wherein the first abutting part is provided with a second extension part extending toward the cover element, the cover element is provided with a pressing piece extending toward the gear control element, and the pressing piece is pressed against the second extension part, thereby generating a tendency force that pushes the part of the gear control element comprising at least the first abutting part toward the gear forming element, the tendency force pushes the first abutting part toward the inner groove part when the gear control element is driven by the support crossbar part and reaches the gear groove, so that the platform part inclines and guides the support crossbar part into the gear groove.

Further, the support element further has two connecting rod parts respectively extending from both sides of the support crossbar part, and the ends of two the connecting rod parts away from the support crossbar part are hinged on the base plate.

The present invention provides an adjustable seat, comprising: a sit board, corresponding to the buttocks of the user; a waist board, corresponding to the waist of the user; and the aforementioned multi-gear adjustable support mechanism, wherein one of the base plate and the support plate is installed on the sit board or is integrally formed with the sit board, and the other of the base plate and the support plate is installed on the waist board or is integrally formed with the waist board.

According to the multi-gear adjustable support mechanism provided by the present invention, the gear forming element is formed with gear grooves corresponding to each support gear and the limiting part corresponding to the unlock gear. The movement control element is movably arranged in the gear forming element. The movement control part further has the platform part that is aligned with the moving surface of the gear forming part and the first abutting part that can abut against the support crossbar part and is located close to the end of the limiting part. Thus, when the support crossbar part moves from top to bottom to the limiting part, the support crossbar part can drive the movement control element to reach the limiting part by abutting against the first abutting part, and the platform part is aligned with the gear groove that is closest to the limiting part. Thereby, when the support crossbar part returns from the limiting part (that is, when the support crossbar part moves from bottom to top), the support crossbar part is blocked by the platform part and cannot enter the gear groove. That is, when the support crossbar part passes through all the support gears and returns from the unlock gear, the support crossbar part will not enter the corresponding gear again. Correspondingly, according to the adjustable seat provided by the present invention, the adjustable seat contains the aforementioned multi-gear adjustable support mechanism. The sit board and the base plate are integrally formed, and the waist board and the support plate is integrally formed. Thereby, when the user uses the adjustable seat, there is no need to manually pull the support element out of the gear groove. In order to unlock the waist board and readjust the gear, the user only needs to turn the waist board.

DETAILED DESCRIPTION OF THE EMBODIMENTS

The present invention is further described in the following embodiments with reference to the drawings, and not only limited to these embodiments.

In the following embodiments, the description of the direction is based on the direction in which the user sits on the adjustable seat. That is, the front refers to the direction in which the user faces, and the back refers to the direction in which the user's back is facing away. The up and down directions respectively refer to the up and down directions of the user, and the left and right directions respectively refer to the left and right directions of the user.

Embodiment 1

Figure 1:
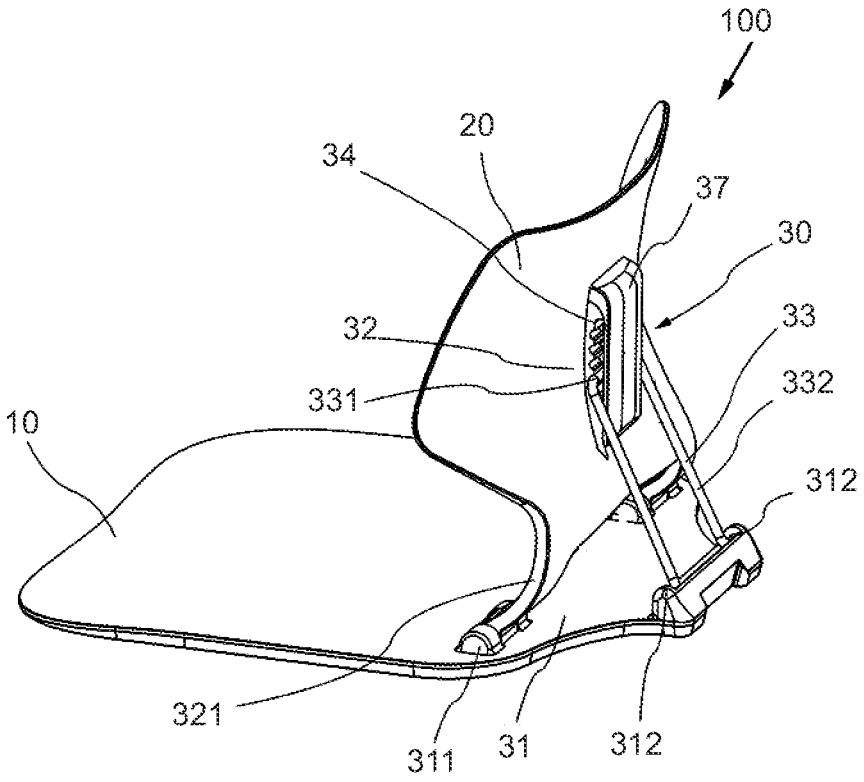
FIG. 1 shows a schematic structural diagram of the adjustable seat according to embodiment 1 of the present invention.

FIG. 1 shows a schematic structural diagram of the adjustable seat according to embodiment 1 of the present invention.

Figure 2:
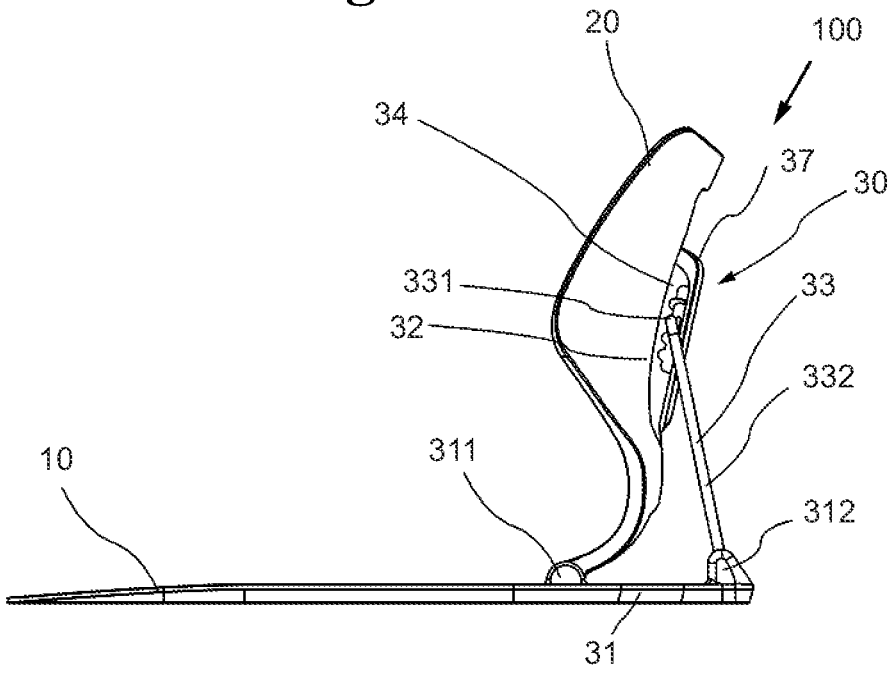
FIG. 2 shows a schematic side view of the structure of the adjustable seat according to embodiment 1 of the present invention.

FIG. 2 shows a schematic side view of the structure of the adjustable seat according to embodiment 1 of the present invention.

Figure 3:
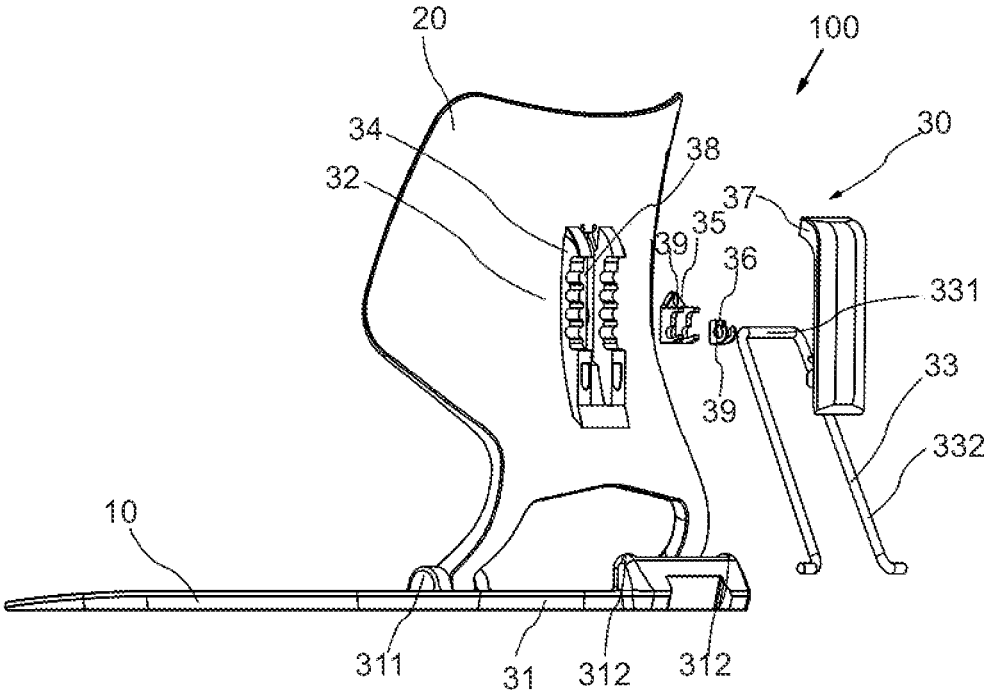
FIG. 3 shows a schematic diagram of an exploded structure of the adjustable seat according to embodiment 1 of the present invention.

FIG. 3 shows a schematic diagram of an exploded structure of the adjustable seat according to embodiment 1 of the present invention.

As shown in FIGS. 1 to 3, the adjustable seat 100 of embodiment 1 comprises the sit board 10, the waist board 20 and the multi-gear adjustable support mechanism 30.

Wherein, the sit board 10 corresponds to the user's buttocks, and supports the user's buttocks during use. In the present embodiment, the bottom surface of the sit board 10 is a flat surface, so the adjustable seat 100 of the present embodiment can be placed on other adjustable seats with support legs by the sit board 10 and can be used in conjunction with these adjustable seats.

The waist board 20 corresponds to the user's waist, and is used to support the user's waist during use.

In the present embodiment, the waist board 20 is formed in a curved shape adapted to the waist of human body.

Figure 4:
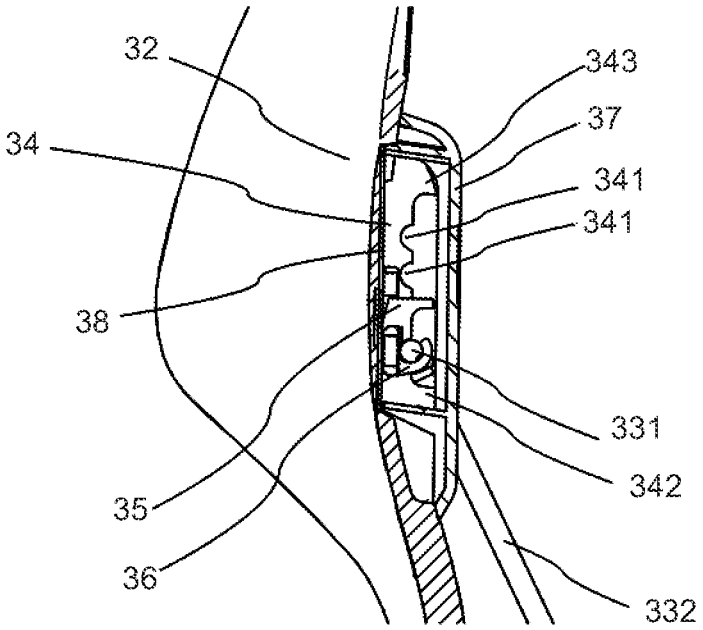
FIG. 4 shows a schematic cross-sectional structure diagram of the multi-gear adjustable support mechanism of embodiment 1 of the present invention.

FIG. 4 shows a schematic sectional view of the structure of the multi-gear adjustable support mechanism according to embodiment 1 of the present invention.

As shown in FIGS. 1 to 4, the multi-gear adjustable support mechanism 30 comprises the base plate 31, the support plate 32, the support element 33, the gear forming element 34, the gear control element 35, the crossbar guiding element 36, the cover element 37, the first magnet element 38 and the second magnet element 39.

The base plate 31 is formed integrally with the sit board. The upper part of the support plate 32 is formed integrally with the waist board, and the lower part of the support plate 32 comprises two connecting parts 321 extending downwards. These two connecting parts 321 are installed on the base plate 31 through the rotating shaft 311, so that the support plate 32 can rotate relative to the base plate 31. And correspondingly, the waist board 20 can also rotates relative to the sit board 10.

The support element 33 is used to support the support plate 32, so that the support plate 32 is stabilized at a certain angle after rotating relative to the base plate 31. At this time, the waist board 20 is also stabilized at a certain angle relative to the sit board 10, and the waist board 20 can support the waist of the user at this angle.

The support element 33 has a support crossbar part 331 for supporting the support plate 32. Two ends of the support crossbar part 331 are respectively provided with two connecting rod parts 332. The ends of the two connecting rod parts 332 away from the support crossbar part 331 are respectively installed in the mounting hole parts 312 provided on the base plate 31, so that the support element 33 can rotate relative to the base plate 31, and thereby supporting the support plate 32 at different positions by the support crossbar part 331.

Specifically, the two mounting hole parts 312 are arranged opposite to each other. The lower ends of the two connecting rod parts 332 are respectively provided with extension portions extending outward horizontally. The extension portions are respectively embedded in the mounting hole parts 312, so that the support element 33 can rotate with the connection of the two mounting hole parts 312 as a rotation axis.

In addition, compared to the shaft 311 for installing the connecting parts 321 of the support plate 32, the mounting hole parts 312 for installing connecting rod part 332 are located at a more rear position on the base plate 31. Therefore, when the user sits on the adjustable seat 100 and leans the waist on the waist board 20, the support element 33 can support the support plate 32 and waist board 20 from behind the support plate 32, thereby supporting the waist board 20.

In this embodiment, a plurality of support positions can be formed after the support crossbar part 331 supports the support plate 32. Correspondingly, the waist board 20 has a plurality of stable angles after being supported by the support crossbar part 331. In other words, the support crossbar part 331 has a plurality of positions that support the waist board 20.

Figure 5:
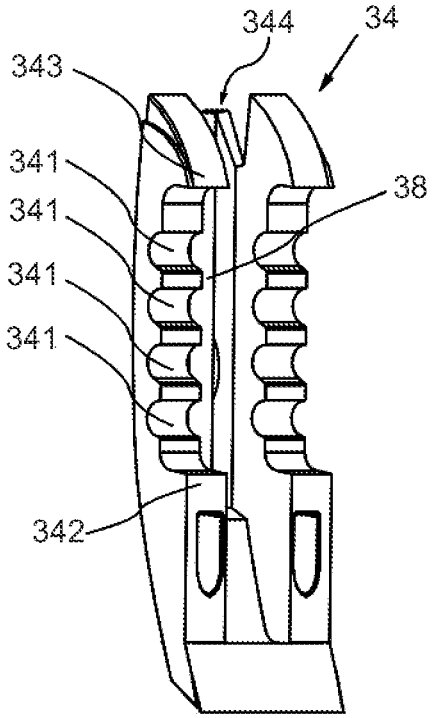
FIG. 5 shows a schematic structural diagram of the gear forming element according to embodiment 1 of the present invention.

FIG. 5 shows a schematic structural diagram of a gear forming element according to embodiment 1 of the present invention.

As shown in FIGS. 3 to 5, the gear forming element 34 in fixed on the rear surface of the support plate 32 by bolts. A plurality of gear grooves 341 are formed on the surface (that is, the moving surface) of the gear forming element 34 away from the support plate 32, and the gear grooves 341 are arranged in a top-to-down direction. The support crossbar part 331 is in contact with the moving surface and can move up and down along the moving surface, thereby entering different gear grooves 341.

In this embodiment, four gear grooves 341 are provided. Each gear groove 341 is semi-circular when viewed from its side. The diameter of each gear groove 341 matches the diameter of the support crossbar part 331, so that the support crossbar part 331 can be accommodated in each gear groove 341 when it enters thereof.

As shown in FIGS. 2 and 5, the support element 33 supports the support plate 32 from behind the support plate 32. Therefore, when the support crossbar part 331 is accommodated in the gear grooves 341, the connecting rod part 332 and the support plate 32 forms an acute angle. The force generated by the user's waist leaning against the waist board 20 is applied to the support crossbar part 331 by the support plate 32 and the gear forming element 34, so that the support crossbar part 331 and the inner surface of the gear groove 341 tightly abuts each other, and a triangular stress structure is formed between the support plate 32, the support element 33 and the base plate 31. Even if the user leans the waist backward forcibly, there will be no relative movement between the support plate 32 and the support element 33 (correspondingly, the angle of the waist board 20 will not change). In this state, the position of the support crossbar part 331 is limited by the gear grooves 341, and the support crossbar part 331 cannot move upward and move out of the gear grooves 341. That is, the support crossbar part 331 is limited by the gear grooves 341.

Thereby, each gear groove 341 corresponds to a plurality of positions where the support crossbar part 331 can be limited. When the support crossbar part 331 is limited by different gear grooves 341, the support crossbar part 331 supports the support plate 32 and the waist board 20 at different angles and different positions, correspondingly. Therefore, different gear grooves 341 actually corresponds to different support gears.

As described above, due to the limit of the gear grooves 341, a triangular stress structure is formed among the support plate 32, the support element 33 and the base plate 31 when they are used together. Therefore, applying a backward force to the waist board 20 does not allow the support crossbar part 331 to move upward out of the corresponding gear groove 341. However, when the user leans the user's upper body forward slightly so that the waist no longer leans against the waist board 20, and stretches the user's hand to turn the waist board 20 forward at the same time, the support crossbar part 331 can be moved downward relative to the support plate 32 and waist board 20, thereby leaving the gear grooves 341.

In this embodiment, the lower end of the gear forming element 34 has a limiting part 342. The limiting part 342 is a protrusion extending outward from the surface of the gear forming element 34 away from the support plate 32. When the support crossbar part 331 moves downward along the surface of the gear forming element 34 and reaches the limiting part 342 at the lower end, the support crossbar part 331 is limited by the limiting part 342 and cannot continue to move downward. In this state, when the user stops pulling the waist board 20 forward and pulls the waist board 20 backward instead, since there is no recessed part such as the gear groove 341 at position of the limiting part 342, the support crossbar part 331 can be moved upward relative to the waist board 20 and the support plate 32 along with the user's action, and thereby leaving the limiting part 342. Therefore, the limiting part 342 also corresponds to a gear, that is, the unlock gear.

In addition, the upper end of the gear forming element 34 also has a limiting protrusion 343 for blocking the support crossbar part 331, which stops the support crossbar part 331 from moving upward when the support crossbar part 331 reaches the uppermost position.

Figure 6:
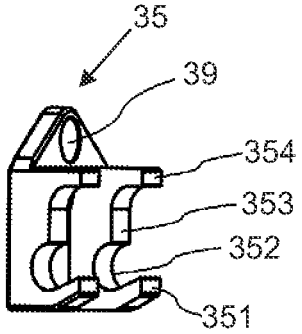
FIG. 6 shows a schematic structural diagram of the movement control element according to embodiment 1 of the present invention.

FIG. 6 shows a schematic diagram of the structure of the movement control element according to embodiment 1 of the present invention.

As shown in FIGS. 3, 5 and 6, the middle portion of the gear forming element 34 is provided with a groove part 344. The groove part 344 extends in an up and down direction. The upper end of the groove part 344 extends to the limiting protrusion 343, and the lower end of the groove part 344 extends to the limiting part 342. The width of the gear control element 35 matches the width of the groove part 344, and the gear control element 35 is accommodated in the groove part 344. Therefore, the gear control element 35 can move inside the groove part 344 and in an up and down direction. In addition, the groove part 344 divides the gear forming element 34 into two portions, therefore each gear groove 341 comprises of two groove portions. The two groove portions are respectively positioned on portions formed by dividing the gear forming element 34 by the groove part 344.

The gear control element 35 is provided with the first abutting part 351, the recess 352, the platform part 353 and the second abutting part 354. They are arranged on the surface of the gear control element 35 close to the support crossbar part 331, and they are arranged in sequence from bottom to top. The limiting part 342 is positioned at the lower end of the gear control element 35, meanwhile the gear control element 35 is positioned in the groove part 344 and the groove part 344 is positioned at the middle portion of the gear forming element 34. Therefore, the first abutting part 351 is positioned at an end close to the limiting part 342 (that is, the lower end), and meanwhile the second abutting part 354 is positioned at an end away from the limiting part 342 (that is, the upper end).

The gear control element 35 has a certain thickness. So, when the gear control element 35 is placed in the groove part 344, the first abutting part 351 and the second abutting part 354 both protrude outward relative to the moving surface of the gear forming element 34. Meanwhile, the surface of the platform part 353 is aligned with the moving surface, and the recess 352 is recessed inward relative to the moving surface. The shape and size of the recess 352 match the shape and size of gear groove 341. Therefore, when the gear control element 35 moves to such position that the recess 352 and the gear groove 341 are aligned, the support crossbar part 331 can enter the gear groove 341. And when the gear control element 35 moves to such position that the platform part 353 and the gear groove 341 are aligned, the surface of the platform part 353 and the moving surface at the gear groove 341 (that is, the moving surface portions of the upper and lower sides of the gear groove 341) are aligned. In this state, the support crossbar part 331 is blocked by the platform part 353. The support crossbar part 331 can only along the surface of the platform part 353, and cannot enter the gear groove 341. In addition, a portion of the surface of the recess 352 adjacent to the first abutting part 351 has a smooth transition.

In the present embodiment, one recess 352 is provided, and the length of the platform part 353 (that is, the size in the up and down direction) is greater than the diameter of the gear groove 341.

Figure 7:
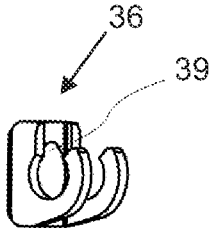
FIG. 7 shows a schematic structural diagram of a crossbar guiding element of embodiment 1 of the present invention.

FIG. 7 shows a schematic structural diagram of the crossbar guiding element according to embodiment 1 of the present invention.

As shown in FIG. 7, in the present embodiment, the crossbar guide element 36 is a hook-shaped element. The hook part of the crossbar guide element 36 is fixed on the support crossbar part 331, so that the crossbar guide element 36 is fixed to the support crossbar part 331.

As shown in FIGS. 1 to 4, the cover element 37 covers the gear forming element 34. The two ends of the cover element 37 are fixed on the support plate 32 by bolts. The cover element 37 is used to prevent the gear control element 35, the crossbar guiding element 36 and etc. from falling off.

The first magnet element 38 is in the shape of a sheet, and is arranged in the groove part 344 and positioned at the bottom of the groove part 344. The length and width of the first magnet element 38 match the length and width of the groove part 344. Therefore, the first magnet element 38 also extends in an up and down direction. The upper end of the first magnet element 38 extends to the uppermost gear groove 341, and the lower end extends to the limiting part 342.

The second magnet element 39 is cylindrical. In the present embodiment, two second magnet elements 39 are provided, and they are respectively fixed on the crossbar guiding element 36 and the gear control element 35.

In the present embodiment, the first magnet element 38 is a magnetic metal piece. The first magnet element 38 and a permanent magnet can attract each other, but the first magnet element 38 itself does not have magnetism. The second magnet element 39 is a permanent magnet and has magnetism. The second magnet element 39 and a magnetic metal piece can attract each other. Therefore, the gear control element 35 is movably arranged in the groove part 344 by the magnetic attraction of the first magnet element 38 and the second magnet element 39.

Similarly, the second magnet element 39 on the crossbar guiding element 36 and the first magnet element 38 attract each other magnetically, so that the crossbar guiding element 36 applies a force toward the gear forming element 34 on the support crossbar part 331. When the support crossbar part 331 reaches the position of the gear groove 341 and is not blocked by the platform part 353, the force causes the support crossbar part 331 to move toward the gear groove 341, so that the support element 33 automatically enters the gear groove 341 without the interference of the user.

In the present embodiment, the second magnet element 39 on the crossbar guiding element 36 is exposed from the surface of the crossbar guiding element 36 close to the first magnet element 38. When the support crossbar part 331 enters the gear groove 341, the surface of the second magnet element 39 is in contact with the first magnet element 38. Therefore, once the support crossbar part 331 enters the gear groove 341, the second magnet element 39 and the surface of the first magnet element 38 slightly collide and make a sound. The sound reminds the user that the corresponding support gear is in place.

In addition, when the support crossbar part 331 moves on the moving surface or on the surface of the platform part 353, since the support crossbar part 331 does not enter the gear groove 341, there is a certain distance between the second magnet element 39 on the crossbar guiding element 36 and the first magnet element 38. At this time, the second magnet element 39 on the crossbar guiding element 36 and the first magnet element 38 still attract to each other and a force is generated thereof. The force makes the support crossbar part 331 always have a tendency to move toward the first magnet element 38, so that the support crossbar part 331 is always attached to the moving surface or the surface of the platform part 353.

The operating principle of the adjustable seat 100 of the present embodiment will be described below with reference to the drawings.

Figure 8:
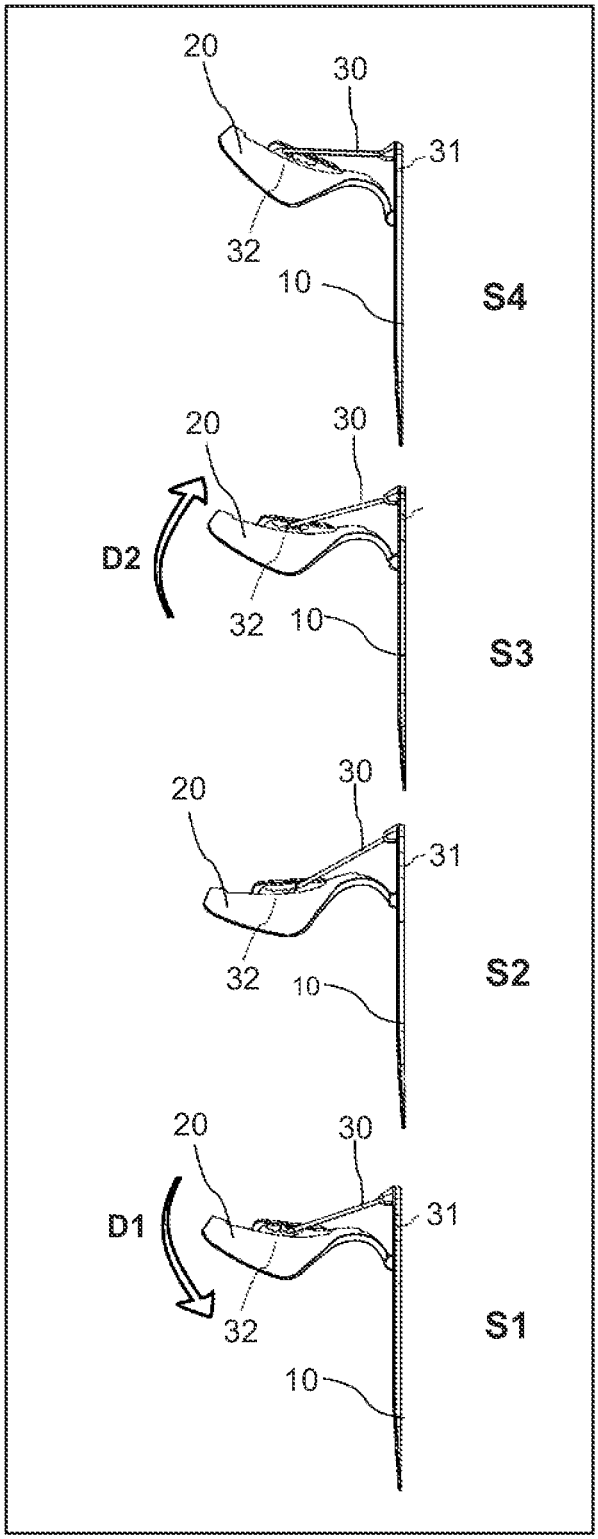
FIG. 8 shows a schematic structural diagram of the adjustable seat in different states according to embodiment 1 of the present invention.
Figure 9:
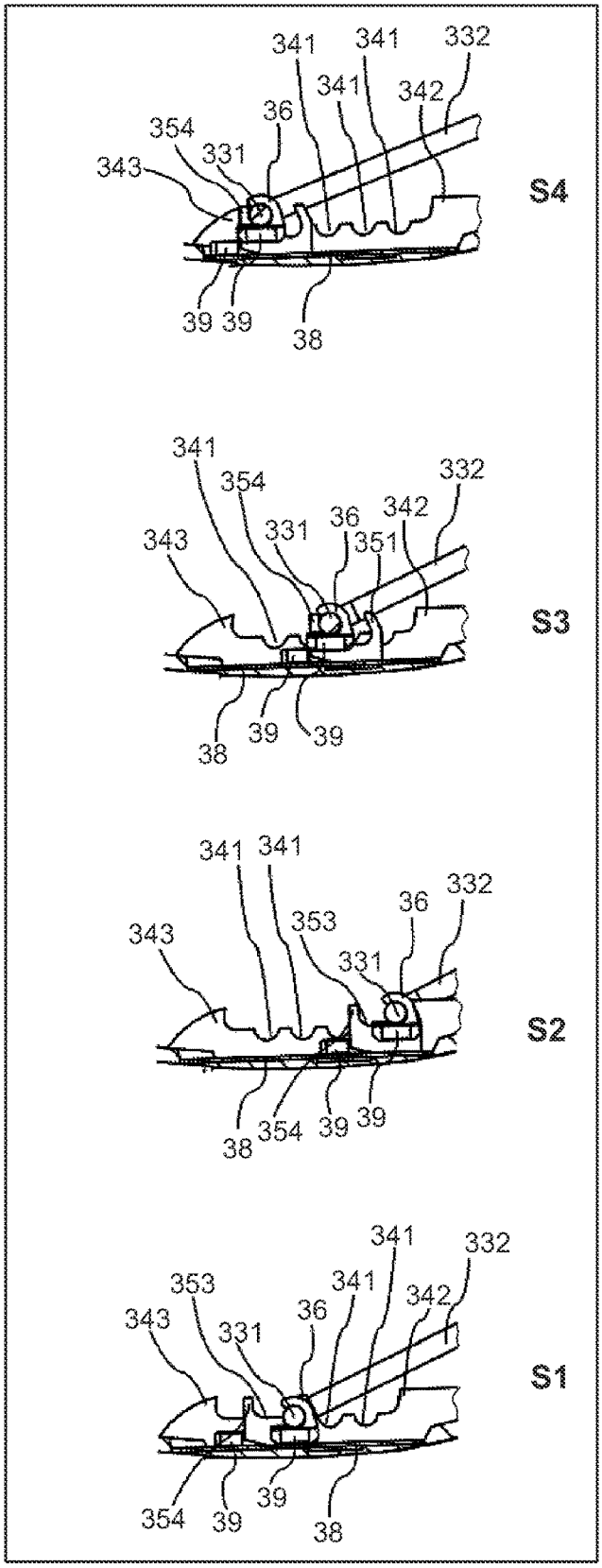
FIG. 9 shows a partial structural diagram of the part of the multi-gear adjustable support mechanism of the adjustable seat in different states of FIG. 8.

FIG. 8 shows a schematic structural diagram of the adjustable seat in different states of embodiment 1 of the present invention. FIG. 9 shows a partial structural diagram of the multi-gear adjustable support mechanism of the adjustable seat in different states of FIG. 8. In FIGS. 8 and 9, arrows D1 and D2 respectively indicate the direction in which the user pulls the waist board 20 to make it rotate, and S1, S2, S3, and S4 indicate different states of the adjustable seat 100 respectively.

As shown in FIGS. 8 and 9, the state S1 is the state that the adjustable seat 100 is in one support gear. In this state, support crossbar part 331 is positioned in one of the gear grooves 341, and supports the support plate 32 and the waist board 20 in a fixed angle. Since a plurality of gear grooves 341 and corresponding support gears are provided, four S1 states are provided, and only one of the S1 states is shown in the drawings.

When the use turns the waist board 20 forward, the waist board 20 rotates forward so that the support crossbar part 331 moves downward relative to the support plate 32. When the support crossbar part 331 moves downward and reaches the first abutting part 351, the support crossbar part 331 abuts against the first abutting part 351 and drives the gear control element 35 to move downward. When the recess 352 is aligned with the next gear groove 341, the attraction force between the second magnet element 39 on the crossbar guiding element 36 and the first magnet element 38 makes the support crossbar part 331 have a tendency to move into the gear groove 341. Therefore, the support crossbar part 331 enters the gear groove 341, that is, the support crossbar part 331 enters the next support gear. In addition, the portion of the recess 352 adjacent to the first abutting part 351 is a smooth transition, therefore the portion of the support crossbar part 331 that abuts against the first abutting part 351 can also slide into the recess 352 smoothly along the adjacent portion. It is equivalent to entering the gear groove 341 aligned with the recess 352.

After entering the next support gear described above, if the user continues to turn the waist board 20, the support crossbar part 331 further enters the support gear after next according to the aforementioned process. The support crossbar part 331 stops when it moves downward to the limiting part 342 and is limited by the limiting part 342. At this time, the adjustable seat 100 is in the state S2.

The limiting part 342 is not provided with the gear grooves 341, therefore the support crossbar part 331 cannot enter the support gear or continue to move downward. When the user releases the user's hands, the waist board 20 and the support plate 32 both rotate slightly backwards due to gravity (the user can also turn the waist board 20 backwards by hand to rotate it backwards, or lean the waist on the waist board 20 so as to rotate the waist board 20 backwards by applying a force from the waist). As a result, the support crossbar part 331 moves upward relative to the support plate 32.

When the support crossbar part 331 moves upward to the seconds abutting part 354, the support crossbar part 331 abuts against the seconds abutting part 354 and drives the gear control element 35 to move upward. The state of this movement process is shown in S3. In this state, the support crossbar part 331 is in contact with the platform part 422.

Therefore, when moving to each of the gear grooves 341, the support crossbar part 331 cannot enter the gear groove 341 due to the blocking of the platform part 422, so that the support crossbar part 331 crosses each of the gear grooves 341 and moves upward to the uppermost limiting protrusion (equivalent to the first support gear). As a result, the adjustable seat 100 reaches the state S4, that is, the reset state.

In this state, the user can turn the waist board 20 forward again, so that the support crossbar part 331 enters each gear groove 341 in turn. The user can also stop turning the waist board 20 when the angle feels appropriate, so that the support crossbar part 331 is limited in the corresponding gear groove 341 after entering thereof. That is, the adjustable seat 100 returns to a different S1 state.

In the above process, when the support crossbar part 331 reaches the limiting part 342 and cannot continue to move downward, the user can turn the waist board 20 backward to move the support crossbar part 331 to the uppermost limiting protrusion. As a result, the adjustable seat reaches state S4, so that it can be adjusted from the uppermost support gear. On the other hand, when the adjustable seat 100 is in state S3, the user can also stop turning the waist board 20 backward at any time during the turning backward process and start to turn the waist board 20 forward again. In this state, the support crossbar part 331 will move downward from the current position and leave the second abutting part 354 and the platform part 353. If the recess 352 is aligned with a certain gear groove 341 at this time, the support crossbar part 331 enters the gear groove 341 and stops at the corresponding support gear. If the recess 352 is not aligned with any of the gear grooves 341 at this time, the support crossbar part 331 will move long the moving surface to the first abutting part 351 and abut against the first abutting part 351, thereby driving the gear control element 35 to move downward until the recess 352 is aligned with a certain gear groove 341 and enter the gear groove 341. Therefore, the adjustable seat 100 of the present embodiment can be adjusted midway. That is, the user can stop turning the waist board 20 backward any time during the adjustment, and turn the waist board 20 forward again to make the support crossbar part 331 enter the closest support gear.

According to the multi-gear adjustable support mechanism provided in the present embodiment, the gear forming element is formed with gear grooves corresponding to each support gear and a limiting part corresponding to the unlock gear. The movement control element is movably arranged on the gear forming element. The movement control element also has a platform part that is aligned with the moving surface of the gear forming element and a first abutting part that abuts against the support crossbar part and is positioned at an end close to the limiting part. Therefore, when the support crossbar part moves from top to bottom to the limiting part, the support crossbar part can drive the movement control element to the limiting part by abutting against the first abutting part. As a result, the platform part is aligned with the gear groove that is closest to the limiting part, so that the surface of the platform part is aligned with the moving surface that is positioned at the gear groove. Thus, when the support crossbar part returns from the limiting part (that is, when moving from bottom to top), the support crossbar part is blocked by the platform part and cannot enter the gear groove. That is, after the support crossbar part has passed all the support gears, it will not enter the corresponding gear when returning from the unlock gear. Correspondingly, according the adjustable seat provided by the present embodiment, the multi-gear adjustable support mechanism is contained, the sit board and the base plate is integrally formed, and the waist board and the support plate is integrally formed. Therefore, when the user uses the adjustable seat, there is no need to manually pull the support element out of the gear grooves, but only to turn the waist board to unlock the waist board and adjust the gears again.

Further, the movement control element in the present embodiment also has a second abutting part at one end away from the limiting part. The second abutting part can abut against the support crossbar part. In this way, when the support crossbar part returns from the limiting part (that is, moving from bottom to top), the movement control element is driven and always moves with the support crossbar part, so that the platform part always blocks the support crossbar part from entering the gear grooves, and the support crossbar part can return to the uppermost end without entering any of the gear grooves. In addition, a recess is provided between the platform part and the first abutting part, and the connecting portion of the recess and the first abutting part is a smooth transition. Therefore, when the support crossbar part abuts against the first abutting part and drives the movement control element to move downward, the recess is aligned with each of the gear grooves in turn, so that the support crossbar part enters each of the gear grooves in turn, and the adjustable seat is adjusted to each of the support gears.

The multi-gear adjustable support mechanism further comprises a crossbar guiding element that applies a force toward the gear forming element and the waist board. The force causes the support crossbar part to enter the gear groove when the support crossbar part moves to the gear groove and the recess is aligned with the gear groove.

In general, in the multi-gear adjustable support mechanism provided by the present embodiment, the gear forming element, the movement control element and the crossbar guiding element cooperate with each other. Therefore, when adjusting the gears, the user only needs to turn the waist board forward or backward, and make the adjustment direction between the support gears opposite to the resetting direction (that is, the direction of adjusting the support gears is that the support crossbar part moves from top to bottom, corresponding to the user moving the waist board forward; and the direction of resetting is that the support crossbar part moves from bottom to top, corresponding to the user moving the waist board backward or the user leaning on the waist board to make the waist board rotate). The user can adjust or reset the support gears without complicated operation.

In addition, the forced applied by the crossbar guiding element to the support crossbar part is achieved by the attraction between the magnetic elements, and the combination between the movement control element and the gear forming element is also achieved by the attraction force between the magnet elements. Therefore, there is no need to provide additional mechanically connected parts or structures between the parts. The structure is relatively simple and easier to manufacture.

Embodiment 2

In embodiment 2, the same reference numbers are used and the same descriptions are omitted for the same structures as in embodiment 1.

Figure 10:
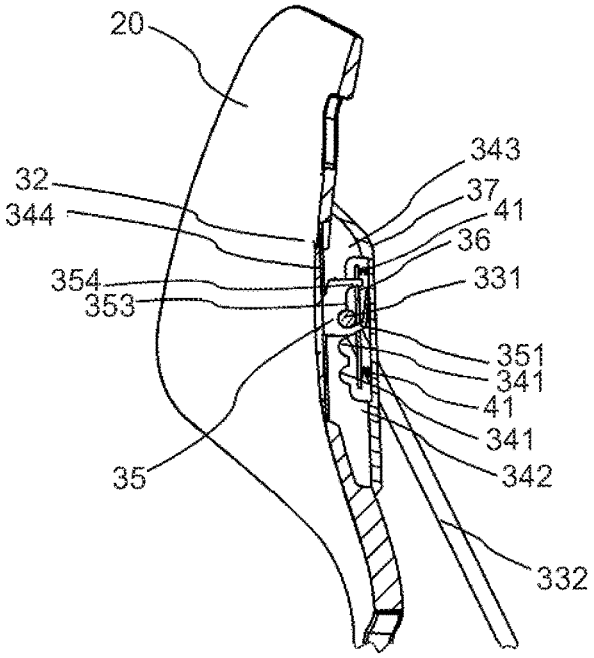
FIG. 10 shows a schematic cross-sectional structure diagram of the multi-gear adjustable support mechanism according to embodiment 2 of the present invention.

FIG. 10 shows a schematic cross-sectional structure diagram of the multi-gear adjustable support mechanism according to embodiment 2 of the present invention.

As shown in FIG. 10, in embodiment 2, the multi-gear adjustable support mechanism 30 comprises the base plate 31 (not shown in FIG. 10), the support plate 32, the support element 33, the gear forming element 34, the gear control element 35, the crossbar guiding element 36, the cover element 37 and the springs 41.

The main difference between the present embodiment and embodiment 1 is that the tendency force on the support crossbar part 331 toward the gear forming element 34 and the support plate 32 is not provided by the mutual attraction between the magnet elements, but by the elastic deformation force of the spring.

Specifically, the crossbar guiding element 36 of the present embodiment is a sheet-shaped element fixed on the cover element 37 by a plurality of springs 41. The sheet-shaped element is in contact with the support crossbar part 331. The upper end of the sheet-shaped element is close to the limiting protrusion 343, and the lower end is close to the limiting part 342. The springs 41 are all compression springs and apply forces toward the support plate 32 on the crossbar guiding element 36. The forces in turn causes the crossbar guiding element 36 to press on the surface of the support crossbar part 331, which in turn presses the support crossbar part 331 on the moving surface of the gear providing element 41. As a result, the support crossbar part 331 can only move along the moving surface, and when it reaches the gear grooves 341, it will automatically enter one of the gear grooves 341 under the influence of the forces of the springs and the crossbar guiding element 36.

In addition, in the present embodiment, the gear control element 35 is no longer arranged in the groove part 334 by the attractive force of the first magnet element 38 and the second magnet element 39, but is movably arranged in the groove part 334 through the guiding groove 345. Specifically, the inner surface of the groove part 344 is provided with a guiding groove 345 extending in the up and down direction. The guiding groove 345 is formed by sinking the surface of the groove part 344, so its cross-section has a concave shape. The gear control element 35 is provided with a fixture block embedded in the guiding groove 345, so that the gear control element 35 is movably arranged in the groove part 334, and the gear control element 35 can move in an up and down direction.

Compared with embodiment 1, in the present embodiment, the tendency force that forces the support crossbar part 331 to move along the moving surface and enter the gear grooves is provided by the compression springs and the sheet-shaped element that is in contact with the support crossbar part 331. Since the springs may be weakened during long-term use, the service life is relatively shorter. However, since the price of the springs is lower than that of the permanent magnets (especially permanent magnets with strong magnetic force), the manufacturing cost is relatively lower.

In the same way, the gear control element 35 is fixed in the groove part 344 by the structure of the guiding groove and the fixture block, but not by the attraction force of the magnet elements. The service life of such mechanical structure is relatively short. But the mechanical structure does not require magnetic metal sheets or permanent magnets, thereby reducing the manufacturing cost.

Embodiment 3

In embodiment 3, the same reference numbers are used and the same descriptions are omitted for the same structures as in embodiment 1.

Compared with embodiment 1 and 2, the difference of the present embodiment is mainly in the structure of the gear control element 35 and the corresponding way of guiding the support crossbar part 331 into the gear grooves 341. In the present embodiment, no recess 352 or similar structure is formed on the gear control element 35. The gear control element 35 guides the support crossbar part 331 into the gear grooves 341 not by means of aligning the recess 352 and the gear groove 341, but by means of steering. The specific structure and operation principle are explained below with reference to the drawings.

Figure 11:
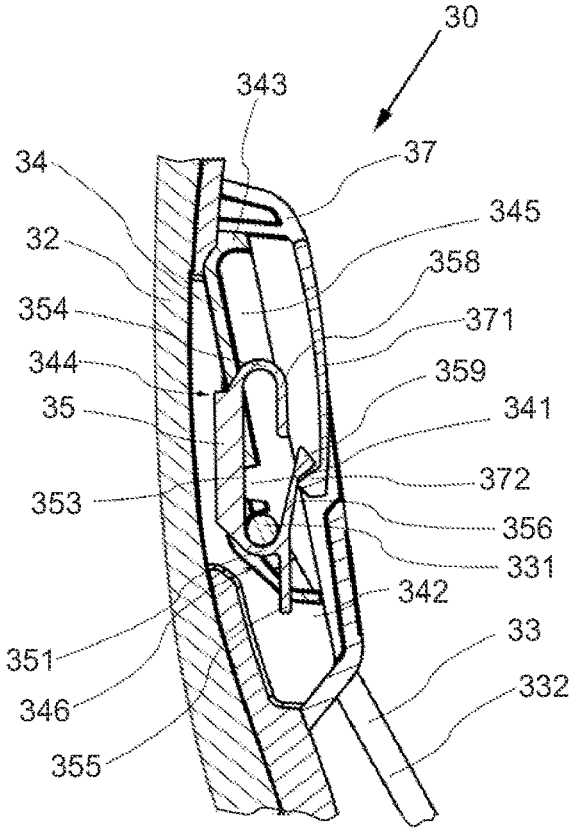
FIG. 11 shows a schematic cross-sectional structure diagram of the multi-gear adjustable support mechanism according to embodiment 3 of the present invention.

FIG. 11 shows a schematic cross-sectional structure diagram of the multi-gear adjustable support mechanism according to embodiment 3 of the present invention.

As shown in FIG. 11, the multi-gear adjustable support mechanism 30 of embodiment 3 comprises the base plate 31 (not shown in FIG. 11), the support plate 32, the support element 33, the gear forming element 34, the gear control element 35 and the cover element 37.

Figure 12:
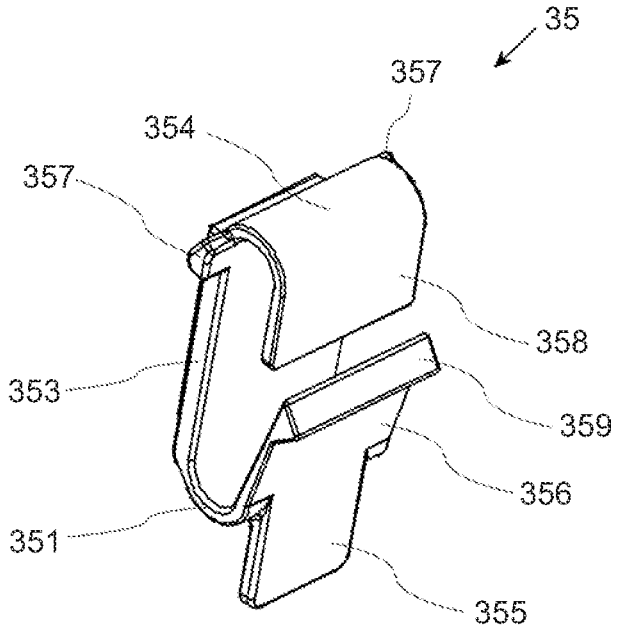
FIG. 12 shows a schematic diagram of the structure of the gear control element of embodiment 3 of the present invention.

FIG. 12 shows a schematic diagram of the structure of the gear control element according to embodiment 3 of the present invention.

As shown in FIGS. 11 and 12, the gear control element 35 is provided with the first abutting part 351, the platform part 353 and the second abutting part 354 that arranged in sequence from bottom to top on the surface of the gear control element 35 close to the support crossbar part 331.

In the present embodiment, the first abutting part 351 is provided with a first extension part 335 extending in a direction away from the platform part 353 (that is, downward) and a second extension part 356 extending toward the cover element 37. Each side of the platform part 353 is provided with a third extension part 357 extending to the side. The end of the second abutting part 354 is provided with a fourth extension part 358 extending toward the first abutting part 351. Therefore, the gear control element 35 as a whole presents an open ring-like structure.

In addition, the third extension parts 357 are both located at a position of the platform part 353 close to the second abutting part 354. The end of the second extension part 356 is also provided with a first protrusive block 359 with a triangular cross-sectional shape.

In other words, compared with the gear control element 35 of embodiment 1, the gear control element 35 of the present embodiment does not have a recess 352, but has the first extension part 355, the seconds extension part 356, the third extension parts 357 and the protrusive block 359 in addition. Correspondingly, since no recess 352 is provided, the first abutting part 351 and the platform part 353 are directly connected to each other, and the connection part of the two presents a smooth transition surface.

In addition, the length of the platform part 353 of the present embodiment is longer, and it is greater than the distance between the upper end of the uppermost gear groove 341 and the lower end of the lowermost gear groove 341.

Figure 13:
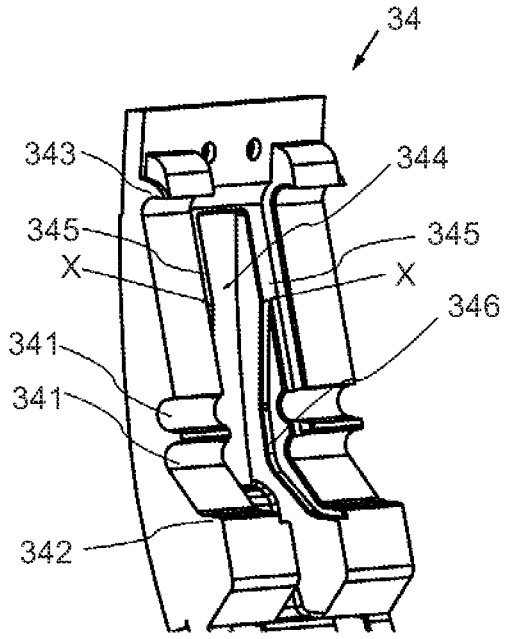
FIG. 13 shows a schematic structural view of the gear forming element of embodiment 3 of the present invention.

FIG. 13 shows a schematic structural diagram of the gear forming element of embodiment 3 of the present invention.

As shown in FIGS. 11 and 13, the gear forming element 34 is formed with two gear grooves 341, and the groove part 344 extending in the length direction (that is, in the up and down direction) is provided in the middle portion of the gear forming element 34. The groove part 334 divides the gear forming element 34 into two portions. The inner edges of the two portions (that is, the edges adjacent to the groove part 344) are partially formed with a guiding groove 345. The guiding groove 345 is formed by sinking the inner edges of the two portions of the gear forming element 34 respectively, so its cross-sectional shape is L-shaped, which is different from embodiment 2.

Two inner groove parts 346 corresponding to the gear grooves 341 are respectively provided on the inner side of the two guiding grooves 345. The inner groove parts 346 are formed by further sinking the inner edges of the two portions of the gear forming element 34, and their cross-sections are also L-shaped. In addition, the depth of the portion of the inner groove parts 346 corresponding to the gear grooves 341 (that is, the distance between the deepest part of the depression corresponding to the gear grooves 341 and the surface of the gear forming element 34) is lower than the depth of the two gear grooves 341, and the depth of the lower end of the inner groove parts 346 (that is, the end close to the limiting part 342) is lower.

In the present embodiment, the distance between the ends of the two third extension parts 357 is greater than the width of the groove part 344. The two third extension parts 357 are placed on the guiding groove 345, so that the gear control element 35 can slide on the guiding groove 345 by the third extension parts 357, so as to be movably arranged in the groove part 344. The shape of the gear grooves 341 is also different from the previous two embodiments. Specifically, the upper surface of the gear grooves is arc-shaped, and the lower surface extends downward obliquely. This shape makes it easier for the support crossbar part 331 to slide out from the lower surface of the gear grooves 341 when the support crossbar part 331 moves downward, thereby leaving the gear grooves 341.

Further, the width of the gear control element 35 (including the width of the platform part 353 and the first abutting part 351) is smaller than the distance between the guiding grooves 345, and larger than the distance between the inner groove parts 346 at the same time. Therefore, when moving to the junction of the inner groove parts 346 and the guiding groove 345 (that is, point X in FIG. 13), the platform part 353 and the first abutting part 351 can move along the inner groove parts 346 so as to enter the gear grooves 341. In contrast, the third extension parts 357 cannot move along the inner groove parts 346, but can only move along the guiding groove 345, and the third extension parts 357 cannot enter the gear grooves 341.

The surfaces of the third extension parts 357 close to the guiding groove 345 are arc-shaped, so the gear control element 34 can also be rotated with the shaft formed by the two third extension parts 357 as a rotation axis. That is, when moving to point X, the gear control element 34 rotates through the shaft formed by the two third extension parts 357, so that the platform part 353 and the first abutting part 351 enter the gear grooves 341.

As shown in FIG. 11, the cover element 37 of the present embodiment is provided with a pressing piece 371 extending toward the second extension part 356. The end of the cover element 37 is further provided with a second protrusive block 372 with a polygonal cross-section. The pressing piece 371 and the second extension part 356 press against each other, and both have a certain elasticity. Therefore, the force of the pressing piece 371 pressing on the second extension part 356 forms a tendency force that pushes the lower portion of the gear control element 35 (that is, the second extension part 356, the first abutting part and etc.) toward the gear forming element 34.

Figure 14:
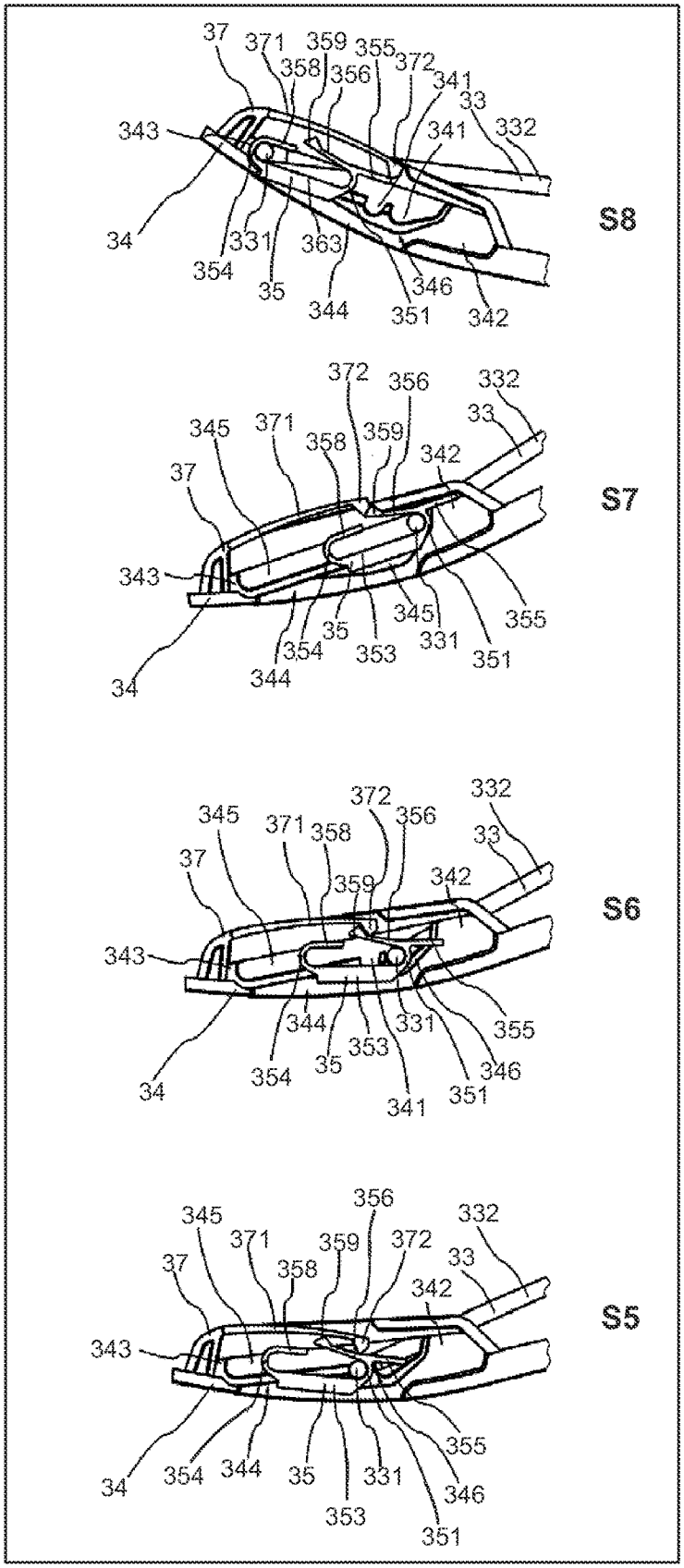
FIG. 14 shows a partial structural diagram of the multi-gear adjustable support mechanism of the adjustable seat in different states of embodiment 3 of the present invention.

FIG. 14 shows a partial structural diagram of the multi-gear adjustable support mechanism of the adjustable seat in different states of embodiment 3 of the present invention. The support plate 32 is omitted in FIG. 14, and at the same time, S5, S6, S7, and S8 correspond to different states of the adjustable seat 100 respectively.

As shown in FIG. 14, S5 shows a state in which the support crossbar part 331 is positioned in the upper gear groove 341. S6 shows a state in which the support crossbar part 331 is positioned in the lower gear groove 341. Each gear grooves 341 corresponds to a support gear. Therefore, S5 and S6 are the states where the adjustable seat 100 is in the support gears, which is equivalent to state S1 of embodiment 1.

In the state of S5, the support crossbar part 31 and the first abutting part 351 are both positioned in the upper gear groove 341. When the user turns the waist board 20 forward to make it rotate forward in direction D1 as shown in FIG. 8, the support crossbar part 31 moves downward along the guiding groove 345. At the same time, the support crossbar part 31 abuts against the first abutting part 351 and drives the gear control element 35 to move downward together with it. The lower surfaces of the gear grooves 341 are inclined, so the support crossbar part 31 can easily move out of the gear grooves 341 and drive the gear control element 35 to move out together with it.

When reaching the lower gear groove 341, the crimping action of the pressing piece 371 and the second extension part 356 generates a tendency force that pushes the lower portion of the gear control element 35 to the gear forming element 34, so the lower portion of the gear control element 35 (including the first abutting part 351) can only approach the inner groove parts 346 or move along the surface of the inner groove parts 346. Therefore, the lower portion of the gear control element 35 faces the bottom of the inner groove parts 346, while the upper portion thereof is always placed on the guiding groove 345 by the third extension parts 357. At this time, the platform part 353 is inclined from the guiding groove 345 to the bottom of the inner groove parts 346.

The support crossbar part 331 is sandwiched between the platform part 353 and the second extension part 356. Therefore, when the platform part 353 is in the aforementioned inclined state, the support crossbar part 331 moves along the platform part 353, and is guided into the lower gear groove 341 by the platform part 353, and reaches the state shown in S6.

When the user further turns the waist board 20 to make the support crossbar part 331 further move downward relative to the gear control element 35, the support crossbar part 331 abuts against the first abutting part 351 and drives the gear control element 35 to move downward continuously, so that the gear control element 35 moves out of the lower gear groove 341. Then, the support crossbar part 331 reaches the limiting part 342 and drives the first abutting part 351 to reach the limiting part 342. Since the depths of the inner groove parts 346 are relatively shallow, the first abutting part 351 moves along the inner groove parts 346 and reaches the limiting part 342. At this time, the surfaces of the first protrusive block 359 and the second protrusive block 372 abut against each other. In this state, the pressing piece 371 and the second extension part 356 also press against each other. The elastic deformation force of the pressing piece 371 and the second extension part 356 makes the surfaces of the first protrusive block 359 and the second protrusive block 372 press against each other, and it is not easy to shift between the two surfaces. Therefore, the lower end portion of the gear control element 35 is stabilized at the position of the limiting part 342, and reaches the state shown in S7. In addition, in this state, the first extension part 355 abuts on the surface of the cover element 37, so that the gear control element 35 shown in state S7 is more stable and less likely to be shifted.

In the state shown in S7, when the user turns the waist board 20 backward, the gear control element 35 is not easily shifted in this state. Therefore, when the support crossbar part 331 moves upward relative to the gear forming element 34, the support crossbar part 331 leaves the first abutting part 351 and moves upward along the platform part 353. The length of the platform part 353 is greater than the distance of the upper end of the uppermost gear groove 341 and the lower end of the lowermost gear groove 341, therefore the platform part 353 is aligned with all the gear grooves 341 at this time, equivalent to that the surface of the platform part 353 is aligned with the moving surface among the gear grooves 341 and other portions. Therefore, the support crossbar part 331 moves on the surface of the platform part 353 so as to pass all the gear grooves 341 at one time and move upward.

When reaching the second abutting part 354, the support crossbar part 331 abuts against the second abutting part 354 and drives the gear control element 35 to move upward. At this time, the driving force that drives the support crossbar part 331 and the gear control element 35 to move upward is provided by the user turning the waist board 20. Therefore, the driving force can overcome the elastic deformation force of the pressing piece 371 and the second extension part 356, so that the first protrusive block 359 is separated from the second protrusive block 372. As a result, the gear control element 35 further moves upward and reaches the limiting protrusion 343, reaching the state shown in S8.

In the state shown in S8, if the user turns the waist board 20 to make the support crossbar part 331 to move downward relative to the gear forming element 34, the support crossbar part 331 abuts against the first abutting part 351 and drives the gear control element 35 to move downward together. When the gear control element 35 passes the point X, the lower portion of the gear control element 35 moves along the surface of the inner groove parts 346 due to the pressing action of the pressing piece 371 and the second extension part 356. As a result, the support crossbar part 331 is guided into the gear grooves 341, returning to the state shown in S5.

Therefore, when using the seat 100 of the present embodiment, if the user needs to adjust the angle between the sit board 10 and the waist board 20 (equivalent to the angle between the support plate 32 and the base plate 31), the user only needs to lean the upper body forward so that the waist temporarily leaves the waist board, and then move the waist board 20 backhand so that the support crossbar part 331 enters the corresponding gear groove 341. During the process, the user does not need to leave the seat 100, nor to bend or twist the waist.

Compared with embodiment 1 or 2, in the present embodiment, the form of recesses formed on the gear control element 35 is not used to guide the support crossbar part 331. Meanwhile, the force toward the gear forming element 34 that drives the gear control element 35 is not provided by magnet elements or springs, but by the elastic deformation force of the pressing piece 371 and the second extension part 356.

The structure of the present embodiment is simpler than that of embodiment 2, and does not require magnet elements as in embodiment 1, therefore with a lower cost than embodiment 1. However, the platform part 353 of the gear control element 35 requires a certain length to ensure that all the gear grooves 341 are covered. When the number of the gear grooves 341 is large, the length of the platform part 353 will be too long. To ensure that the inclination angle of the platform part 353 is suitable for guiding the support crossbar part 331 into the gear grooves 341, the inner groove parts 346 need to be make deeper. In this case, the platform part 353 is too long and the inner groove parts 346 are too deep, therefore the movement and rotation of the gear control element 35 are not smooth enough. It is even difficult to smoothly guide the support crossbar part 331 into or out of the gear grooves 341. Therefore, under the premise of ensuring smooth use, the multi-gear adjustable support mechanism 30 of the present embodiment should not be made into a form with a large number of gears. Generally, 2 to 4 gears are sufficient.

In addition, the platform part 353 of the present embodiment allows the support crossbar part 331 to pass over all the gear grooves 341 at one time. Therefore, when the support crossbar part 331 reaches the unlock gear, the support crossbar part 331 can only move upward to the uppermost gear groove 341 and continue to move upward. In this way, the gear control element is driven to move upward, and the first protrusive block and the second protrusive block are separated. After the first protrusive block and the second protrusive block are separated, the support crossbar part 331 can enter each gear groove 341 in sequence again. Therefore, the multi-gear adjustable support mechanism cannot achieve midway adjustment, and the flexibility of use is not as good as embodiment 1 or 2.

The aforementioned embodiments are only used to illustrate the specific implementations of the present invention, and the multi-gear adjustable support mechanism and the adjustable seat of the present invention are not limited to the scope of the aforementioned embodiments.

In embodiment 1 and 2, a recess is provided on the movement control element. However, in the present invention, a plurality of recesses can be provided on the movement control element to achieve the same gear controlling effect, as long as the number of the recesses is not greater than that of the gear grooves. When a plurality of recesses is provided on the movement control element, the length of the whole movement control element will be longer than that of the embodiments. But as long as the length is not greater than the distance of the uppermost gear and the limiting part, the recesses can make the support crossbar part drive the movement control element to move up or down by abutting the first abutting part or the second abutting part respectively, thereby achieving gear adjustment or resetting.

In each embodiment, the gear forming element is fixedly arranged on the support plate. However, in the present invention, the gear forming element can also be integrally formed with the support plate.

In addition, four gear grooves are provided in embodiment 1 and 2, while two gear grooves are provided in embodiment 3. However, in the present invention, fewer or more gear grooves can be provided, such as three or five, so as to provide more support gears for the user to choose. Especially in the form of embodiment 1, the gear control element is arranged on the gear forming element by magnetic force, and the tendency force between the support crossbar part and the crossbar guiding element is also provided by magnetic force. In this form, the number of the gear grooves is not as limited as in embodiment 3, therefore it is suitable for occasions with a large number of gears.

In addition, in the embodiments, the support plate is integrally formed with the waist board, and the base plate is integrally formed with the sit board. In the present invention, the corresponding relationship can be altered. That is, the support plate is integrally formed with the sit board, and the base plate is integrally formed with the waist board. In this form, the gear grooves and limiting part on the gear forming element are not distributed in the up and down direction, but in a front and back direction. Correspondingly, when the user turns the waist board, the support crossbar part moves in the front and back directions (rather than the up and down directions) on the moving surface of the gear forming element to enter each support gear. Such an adjustable seat also has the same function of adjusting and resetting the support gears as the embodiments and has basically the same effect. However, it is necessary to leave enough space on the sit board for the support plate. As a result, the adjustable seat has a relatively larger length in the front-to-rear direction and takes a correspondingly larger floor area. Therefore, the adjustable seat is not as portable as the adjustable seats in the aforementioned embodiments.

In the embodiments, the adjustable seat is provided with waist board and sit board. The user sits directly on the sit board while using, and the user's waist leans on the waist board. In the present invention, a sit surface made of flexible material can be further provided to improve the comfort of the adjustable seat. The sit surface can be continuously covered on the sit board and the waist board, and does not affect the rotation of the waist board. The user feels comfortable by contacting with the flexible material.

In the embodiments, the lower surface of the sit board is flat, therefore the adjustable seat of the aforementioned embodiments can be used on other adjustable seats. However, in the present invention, the sit board can be further provided with supporting legs, which allows the adjustable seat of the present invention to be put directly on the ground. More than that, the waist board of the embodiments only corresponds to and supports the user's waist. However, the waist board of the present invention can be extended and provided with accessory parts such as a neck pillow, so that the adjustable seat can also support the user's other body parts such as the neck, thereby further improving the comfort of use. In this structure, due to the larger size of the waist board the corresponding increase in weight, each member of the gear control component should be made of higher-strength materials.

What is claimed is:

1. A multi-gear adjustable support mechanism, comprising:

a base plate;

a support plate, which is rotatably installed on said base plate;

a support element, which is rotatably installed on said support plate, and has a support crossbar to support said support plate at a different angle from said base plate;

a gear forming element, fixed on said support plate, on which a plurality of support gears arranged in a predetermined direction and corresponding to different angles between said base plate and said support plate are formed; and a gear controller to control movement of said support crossbar on said gear forming element so that said support element supports said support plate with a different support gear;

wherein said gear forming element comprises a moving surface to support the movement of said support crossbar, a plurality of gear grooves, formed on the moving surface, respectively corresponding to said support gears and configured to accommodate said support crossbar, and a limiting part formed on the moving surface;

wherein said gear controller is movably arranged on said gear forming element in the predetermined direction, said gear controller comprises a first abutting part configured to abut against said support crossbar and positioned at an end of said gear control element close to said limiting part, and a platform positioned remote from said limiting part and corresponding to said plurality of gear grooves;

wherein said support crossbar abuts against the first abutting part and drives said gear controller to move when said support crossbar moves towards said limiting part in the predetermined direction, the platform is at least aligned with the moving surface and positioned at a gear groove closest to said limiting part when said support crossbar reaches said limiting part, thereby allowing said support crossbar to move on a surface of the platform and crosses said plurality of gear grooves when said support crossbar returns from said limiting part.

2. The multi-gear adjustable support mechanism of claim 1, wherein an end of said gear controller remote from said limiting part comprises a second abutting part configured to abut against said support crossbar; and wherein said support crossbar abuts against the second abutting part and drives said gear controller to move when said support crossbar moves in a direction away from said limiting part.

3. The multi-gear adjustable support mechanism of claim 2, wherein said gear controller comprises a recess positioned between the first abutting part and the platform, a shape of the recess matches a shape of said plurality of gear grooves, when said support gear crossbar moves along the predetermined direction and drives said gear controller to move by abutting against the first abutting part, the recess is sequentially aligned with each of said plurality gear grooves in response to movement of said gear controller, such that said support crossbar is configured to enter a gear groove aligned with the recess when the support crossbar stops moving.

4. The multi-gear adjustable support mechanism of claim 3, wherein said gear controller comprises a plurality of recesses, a number of said plurality of recesses being not greater than a number of said plurality of gear grooves, and a distance between adjacent recesses is the same as a distance between adjacent gear grooves.

5. The multi-gear adjustable support mechanism of claim 3, further comprising a crossbar guide to provide a tendency force to move said support crossbar into said gear groove aligned with the recess.

6. The multi-gear adjustable support mechanism of claim 5, wherein said crossbar guide is a hook-shaped element fixed on said support crossbar, a first magnet element extending along the predetermined direction and distributed at least at each of said plurality of gear grooves is provided at said gear forming element, and a second magnet element is fixed on said crossbar guide, the first magnet element and said second magnet element are attracted to each other by magnetic force, thereby generating the tendency force.

7. The multi-gear adjustable support mechanism of claim 5, further comprising a first magnet element extending along the predetermined direction and distributed at least at each of said plurality of gear grooves provided on said gear forming element; and a second magnet element is fixedly arranged on said gear controller; and wherein the second magnet element and the first magnet element are attracted to each other by magnetic force, so that said gear controller is attracted to said gear forming element and can move relative to said gear forming element.

8. The multi-gear adjustable support mechanism of claim 5, wherein said first magnet element is a magnetic metal sheet and said second magnet element is a permanent magnet.

9. The multi-gear adjustable support mechanism of claim 5, further comprising a cover covering said gear forming element.

10. The multi-gear adjustable support mechanism of claim 9, wherein said crossbar guide is a sheet-shaped element fixed on the cover element by a plurality of springs and said crossbar guide is in contact with said support crossbar, said plurality of springs are compression springs applying a force toward said crossbar guide, such that said crossbar guide applies the tendency force on said support crossbar.

11. The multi-gear adjustable support mechanism of claim 1, wherein said gear forming element comprises a groove part extending along the predetermined direction, the groove part comprises a guiding groove extending along the predetermined direction; and wherein said gear controller is movably arranged on said gear forming element through the guiding groove.

12. The multi-gear adjustable support mechanism of claim 11, wherein said gear controller comprises a fixture block embedded in the guiding groove, so that said gear controller can be movably arranged on said gear forming element in an up-and-down direction.

13. The multi-gear adjustable support mechanism of claim 11, wherein an inner side of the guiding groove is provided with an inner groove part, the inner groove part corresponding to one of said plurality of gear grooves, and a depth of the inner groove part is less than a depth of said one of said plurality of gear grooves; and wherein each of two sides of the platform comprises an extension overlaid on the guiding groove, a distance between ends of each extension is greater than a width of the inner groove part such that said gear controller is slidable on the guiding groove by the extensions.

14. The multi-gear adjustable support mechanism of claim 13, wherein said gear forming element comprises two groove parts extending along the predetermined direction, each groove part comprising a guiding groove extending along the predetermined direction; wherein an inner side of each guiding groove is provided with an inner groove part, the inner groove parts corresponding to two of said plurality of gear grooves; wherein widths of the platform and said first abutting part are both smaller than a distance between the two guiding grooves and greater than a distance between the two inner groove parts; and wherein said support crossbar drives said first abutting part to move and said gear controller rotates through a shaft formed by the two extensions when said first abutting part reaches said one of said plurality of gear grooves, such that the platform and said first abutting part enter said one of said plurality of gear grooves, thereby guiding said support crossbar to enter said one of said plurality of gear grooves.

15. The multi-gear adjustable support mechanism of claim 13, wherein a length of the platform is greater than a distance between ends of said plurality of gear grooves, such that the platform is aligned with the moving surface positioned at the gear groove closest to the said limiting part when said support crossbar reaches said limiting part, thereby allowing said support crossbar to cross all of said plurality of gear grooves by the platform.

16. The multi-gear adjustable support mechanism of claim 13, further comprising a covering to cover said gear forming element; wherein said first abutting part comprises a second extension part extending towards the covering, the covering comprising a pressing piece extending toward said gear controller, the pressing piece configured to press against the second extension part to generate a tendency force that pushes at least said first abutting part towards said gear forming element, said first abutting part is pushed towards the inner groove part by the tendency force when said gear controller is driven by said support crossbar and reaches said one of said plurality of gear grooves, so that said platform part inclines and guides said support crossbar into said one of said plurality of gear grooves.

17. The multi-gear adjustable support mechanism of claim 1, wherein said support element further comprises two connecting rod parts respectively extending from both sides of said support crossbar, ends of the two connecting rod parts remote from said support crossbar are hinged on said base plate.

18. An adjustable seat, comprising: a sit board, corresponding to buttocks of a user; a waist board, corresponding to a waist of the user; and the multi-gear adjustable support mechanism of claim 1, wherein one of said base plate and said support plate is installed on the sit board or is integrally formed with the sit board, and the other of said base plate and said support plate is installed on the waist board or is integrally formed with the waist board.

* * * * *